US009388703B2

(12) United States Patent
Ikeguchi et al.

(10) Patent No.: US 9,388,703 B2
(45) Date of Patent: Jul. 12, 2016

(54) GAS TURBINE ENGINE HAVING A GAP BETWEEN AN OUTLET GUIDE VANE AND AN INNER WALL SURFACE OF A DIFFUSER

(75) Inventors: Takuya Ikeguchi, Kobe (JP); Yusuke Sakai, Kobe (JP); Koji Terauchi, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 884 days.

(21) Appl. No.: 13/635,892

(22) PCT Filed: Mar. 18, 2011

(86) PCT No.: PCT/JP2011/001610

§ 371 (c)(1),
(2), (4) Date: Oct. 16, 2012

(87) PCT Pub. No.: WO2011/114744

PCT Pub. Date: Sep. 22, 2011

(65) Prior Publication Data

US 2013/0039753 A1 Feb. 14, 2013

(30) Foreign Application Priority Data

Mar. 19, 2010 (JP) ..... 2010-064202

(51) Int. Cl.
*F01D 9/04* (2006.01)
*F04D 29/54* (2006.01)
(Continued)

(52) U.S. Cl.
CPC ..... *F01D 9/042* (2013.01); *F01D 25/246* (2013.01); *F04D 29/542* (2013.01); *F04D 29/644* (2013.01)

(58) Field of Classification Search
CPC ..... F01D 9/04; F01D 9/041; F01D 9/042; F01D 25/246; F01D 5/143; F05D 2240/14; F04D 25/942
USPC ..... 416/215
See application file for complete search history.

(56) References Cited

U.S. PATENT DOCUMENTS 3,326,523 A * 6/1967 Bobo ..... F01D 9/042 415/209.3
4,655,038 A * 4/1987 Linsi ..... 60/602
(Continued)

FOREIGN PATENT DOCUMENTS

JP 11294185 10/1999
JP 2000314397 11/2000
(Continued)

OTHER PUBLICATIONS

ISA Japan, International Search Report of PCT/JP2011/001610, Jun. 14, 2011, WIPO, 2 pages.

*Primary Examiner* — Dwayne J White
*Assistant Examiner* — Kayla McCaffrey
(74) *Attorney, Agent, or Firm* — Alleman Hall McCoy Russell & Tuttle LLP

(57) ABSTRACT

A gas turbine engine is provided, which comprises an outlet guide vane provided downstream of a compressor; an outer casing supporting a radially outward part of the outlet guide vane; and an inner diffuser supporting a radially inward part. The outlet guide vane includes a radially inward inner flange; a projecting part projecting radially inward from the inner flange; and an engagement part protruding to one side in an axial direction of the projecting part. The inner diffuser includes a smaller-diameter part having a smaller outer diameter than the other part located upstream. The inner diffuser is provided with an engagement groove extending to one side in the axial direction from an outer peripheral surface of the smaller-diameter part or a region in the vicinity thereof. The engagement part is inserted into the engagement groove with a gap between the engagement part and groove.

6 Claims, 4 Drawing Sheets

(51) Int. Cl.
*F04D 29/64* (2006.01)
*F01D 25/24* (2006.01)

(56) References Cited

U.S. PATENT DOCUMENTS 4,907,944 A * 3/1990 Kroger et al. ..... 415/65
7,481,618 B2 * 1/2009 Booth et al. ..... 415/191
7,753,648 B2 * 7/2010 Evans et al. ..... 415/191
2009/0123275 A1 5/2009 Schirle et al.

FOREIGN PATENT DOCUMENTS

JP 2004084572 3/2004
JP 2005194903 7/2005
JP 2009002338 1/2009

* cited by examiner

GAS TURBINE ENGINE HAVING A GAP BETWEEN AN OUTLET GUIDE VANE AND AN INNER WALL SURFACE OF A DIFFUSER

TECHNICAL FIELD

The present invention relates to a gas turbine engine having an outlet guide vane located downstream of a compressor.

BACKGROUND ART

A gas turbine engine which uses an axial (axial-flow) compressor includes a diffuser located downstream of a compressor. An outlet guide vane is provided at an inlet of the diffuser. When the outlet guide vane is supported on the outer wall surface of the diffuser, a gap is often provided between the outlet guide vane and the inner wall surface of the diffuser. To prevent the thermally expanded outlet guide vane from contacting the inner wall surface of the diffuser, the gap is provided between the outlet guide vane and the inner wall surface of the diffuser. In this structure, air leaks through the gap and a pressure loss increases, which may reduce the compressor efficiency. To solve this problem, there is a gas turbine in which a recess is formed in the inner wall surface of the diffuser and the front edge of the outlet guide vane is inserted into the recess to prevent air leakage (e.g., see FIG. 8 in Patent Literature 1).

CITATION LISTS

Patent Literature

Patent Literature 1: Japanese Laid-Open Patent Application Publication No. 2000-314397

SUMMARY OF THE INVENTION

Technical Problem

However, even when the front edge of the outlet guide vane is inserted into the recess of the diffuser, the vibration is easily generated at the vane because it is supported only on the outer wall surface side of the diffuser. This vibration sometimes causes the front edge of the vane to contact the recess, which may a wear-out of the vane.

Therefore, an objective of the present invention is to provide a gas turbine engine which is capable of suppressing a vibration of an outlet guide vane while permitting the vane to be thermally expanded.

Solution to Problem

According to the aspect of the present invention, a gas turbine engine comprises an outlet guide vane downstream of a compressor; an outer casing supporting a radially outward part of the outlet guide vane; and an inner diffuser supporting a radially inward part of the outlet guide vane; wherein the outlet guide vane has: a radially inward inner flange; a projecting part projecting radially inward from the inner flange; and an engagement part protruding to one side in an axial direction from a front edge of the projecting part; and wherein the inner diffuser has a smaller-diameter part, of which an outer diameter is smaller than that of an adjacent part; the inner diffuser is provided with an engagement groove extending to the one side in the axial direction of an outer surface of the smaller-diameter part or a region in the vicinity of the outer surface of the smaller-diameter part; and the engagement part is inserted into the groove with a gap between the part and the groove.

In accordance with this configuration, since the outlet guide vane is supported at both sides by the inner diffuser and the outer casing, a vibration of the vane can be suppressed. Moreover, because the engagement part is inserted into the groove with the gap, thermal expansion of the vane can be permitted.

Advantageous Effects of the Invention

In accordance with the gas turbine engine of the present invention, the vibration of the outlet guide vane can be suppressed while permitting thermal expansion of the vane.

DESCRIPTION OF THE EMBODIMENTS

A preferred embodiment of the present invention is described as follows with reference to the drawings.

<Outline of Gas Turbine>

Figure 1:
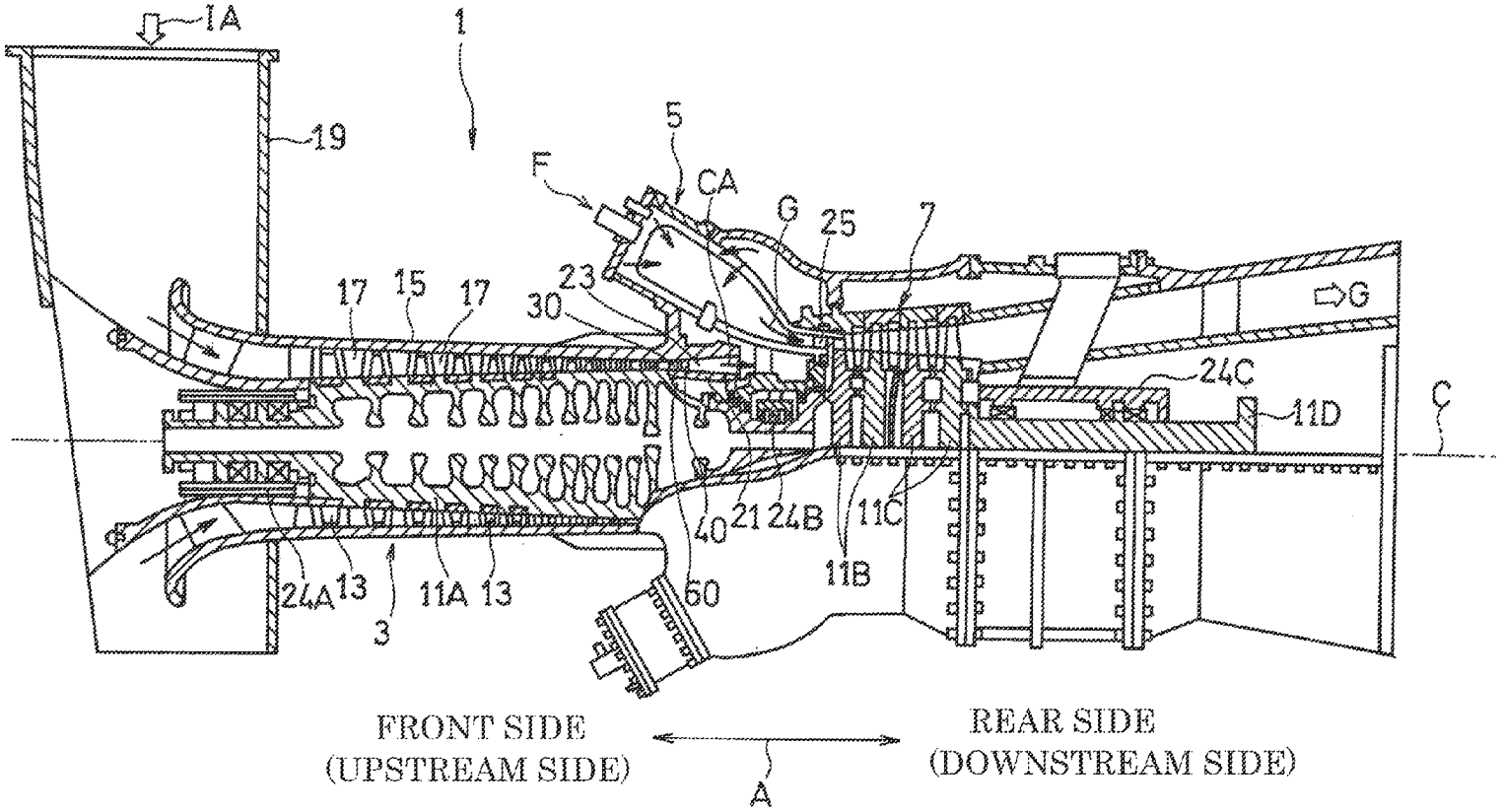
FIG. 1 is a cross-sectional view showing a gas turbine engine according to an embodiment of the present invention.

First of all, the air flow and major components of a gas turbine engine (referred to as "gas turbine") are described with reference to FIG. 1 according to the present embodiment. FIG. 1 is a cross-sectional view drawing the gas turbine according to the embodiment of the present invention. Here, a compressor 3 side of a gas turbine 1 in a center axis direction A is referred to as a "front side" or "upstream side". On the other hand, a turbine 7 side of the gas turbine 1 in the center axis direction A is referred to as a "rear side" or "downstream side."

Initially, air IA passed through an air-intake collector 19 is compressed in a compressor 3. The compressor 3 of the present embodiment is an axial (axial-flow) compressor and includes a number of stages of rotor blades 13 and those of stages of stator vanes 17. The respective stages of rotor blades 13 are mounted to the outer peripheral surface of a compressor rotor 11A and axially arranged at predetermined intervals r. Each stage of stator vane 17 is located downstream of the corresponding stage of rotor blade 13, and mounted to an outer casing 15. As described later, a last-stage stator vane 30 is mounted by a different support structure compared to other stator vanes 17.

Then, compressed air CA which has been compressed by the compressor 3 flows through a diffuser 23 located downstream of the compressor 3 via an outlet guide vane 40. The outlet guide vane 40 is located downstream of the last-stage stator vane 30 of the compressor 3 and neighborhood of the vane 30 (see FIG. 4). The diffuser 23 includes an inner diffuser 21 covering the rear part of the compressor rotor 11A and the outer casing 15. That is, the inner diffuser 21 corresponds to the inner wall surface of the diffuser 23 and the outer casing 15 corresponds to the outer wall surface of the diffuser 23.

Then, the compressed air CA which has passed through the diffuser 23 is guided to a combustor 5. In the combustor 5, the compressed air CA and a fuel F injected into the combustor 5 are mixed and combusted. Thus, high-temperature and high-pressure combustion gas G are generated.

After that, the combustion gas G generated in the combustor 5 flows through a turbine nozzle (first-stage stator vane) 25 and drives the turbine 7. A high-pressure turbine rotor 11B is rotatably supported by bearings 24A and 24B. A low-pressure turbine rotor 11C is supported by bearings 24C via a turbine shaft 11D coupled to the rear part of the rotor 11C. The rotor 11B is coupled to the compressor rotor 11A to drive the rotor 11A.

<Configuration of Outlet Guide Vane>

Figure 2A:
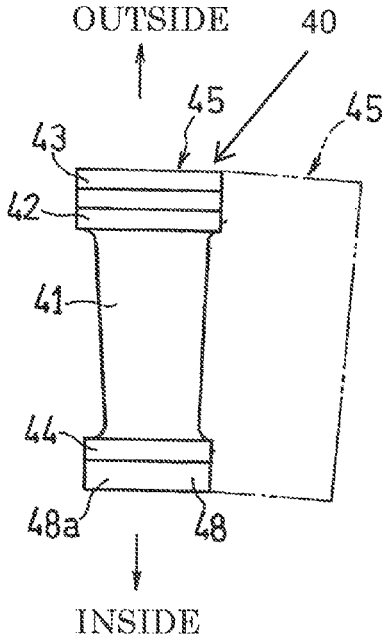
FIG. 2A is a front view of a guide vane piece according to the embodiment.
Figure 2B:
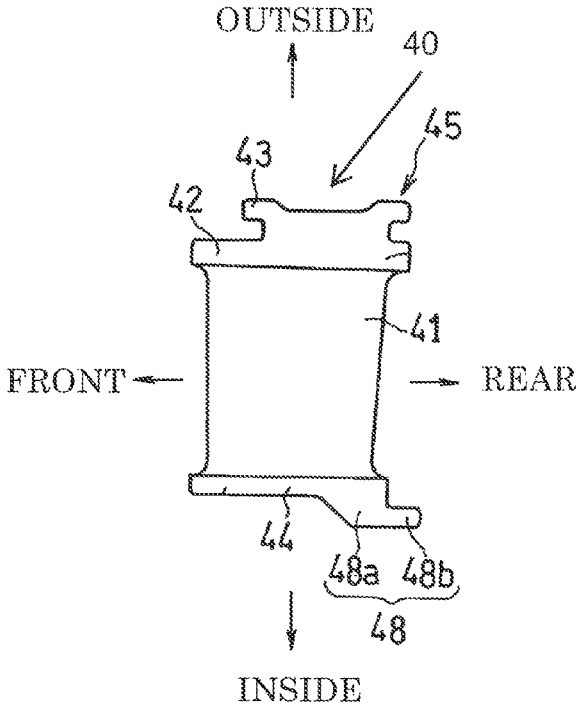
FIG. 2B is a side view of a guide vane piece according to the embodiment

Next, the configuration of the outlet guide vane 40 of the present embodiment is illustrated in FIGS. 2A and 2B as reference. The outlet guide vane 40 is formed by a number of guide vane pieces 45. As indicated by a two-dotted line in FIG. 2A, the guide vane pieces 45 are arranged adjacently in a circumferential direction. Each guide vane piece 45 includes a vane airfoil 41 which is a main body, an outer flange 42 located radially outward, and an inner flange 44 located radially inward. The outer flange 42 is configured as well as each stage of stator vane 17 constituting the compressor 3. Specifically, as shown in FIG. 2B, the outer flange 42 includes a pair of front and rear engagement parts 43 formed integrally with the outer flange 42. As shown in FIG. 2A, the engagement part 43 extends over the overall width of the outer flange 42 in the circumferential direction.

The configuration of inner flange 44 is as follows. As shown in FIG. 2B, the inner flange 44 has an engagement part 48 in a rear. The engagement part 48 has a projecting part 48*a* projecting radially inward from the rear part of the inner flange 44, and an engagement part 48*b* protruding rearward (toward a downstream side) from the projecting part 48*a*. As shown in FIG. 2A, the engagement part 48 extends over the overall width of the inner flange 44 in the circumferential direction. Each of the inner surface of the front part of the inner flange 44, and an outer surface 48*bb* (see FIG. 4) of the engagement part 48*b* has a circular-arc surface concentric with a center axis C (see FIG. 1) of the compressor 3.

<Configuration of Stator Vane>

Figure 3A:
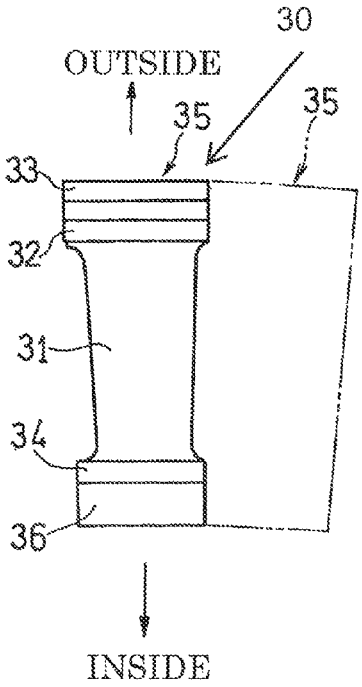
FIG. 3A is a front view of a last-stage stator guide vane piece according to an embodiment of the present invention.
Figure 3B:
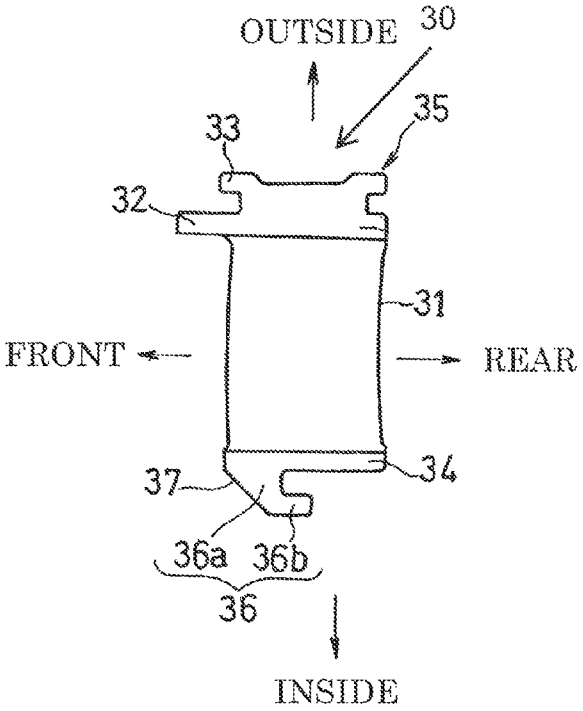
FIG. 3B is a side view of the last-stage stator guide vane piece according to the embodiment.

Next, the configuration of the last-stage stator vane (referred to as "stator vane") 30 of the compressor 3 of the present embodiment is illustrated in FIGS. 3A and 3B. The stator vane 30 is formed by a number of stator vane pieces 35. As shown by the two-dotted line in FIG. 3A, the stator vane pieces 35 are arranged adjacently in the circumferential direction. The stator vane piece 35 includes a stator vane airfoil 31 which is a main body, an outer flange 32 located radially outward, and an inner flange 34 located radially inward. The outer flange 32 is configured as well as other stator vanes 17 constituting the compressor 3. Specifically, as shown in FIG. 3B, the outer flange 32 has a pair of front and rear engagement parts 33 formed integrally. As shown in FIG. 3A, the engagement part 33 extends over the width of the outer flange 32 in the circumferential direction.

The configuration of an inner flange 34 is shown below. The foreside of an inner flange 34 has an engagement part 36. The engagement part 36 includes a projecting part 36*a* projecting radially inward from the front end of the inner flange 34, and an engagement part 36*b* protruding rearward from the projecting part 36*a*. As shown in FIG. 3A, the engagement part 36 extends overall the width of the inner flange 34 in the circumferential direction. An outer surface 36*bb* (see FIG. 4) of the engagement part 36*b* has a circular-arc surface concentric with the center axis C of the compressor 3.

<Support Structure of Guide Vane Piece>

Figure 4:
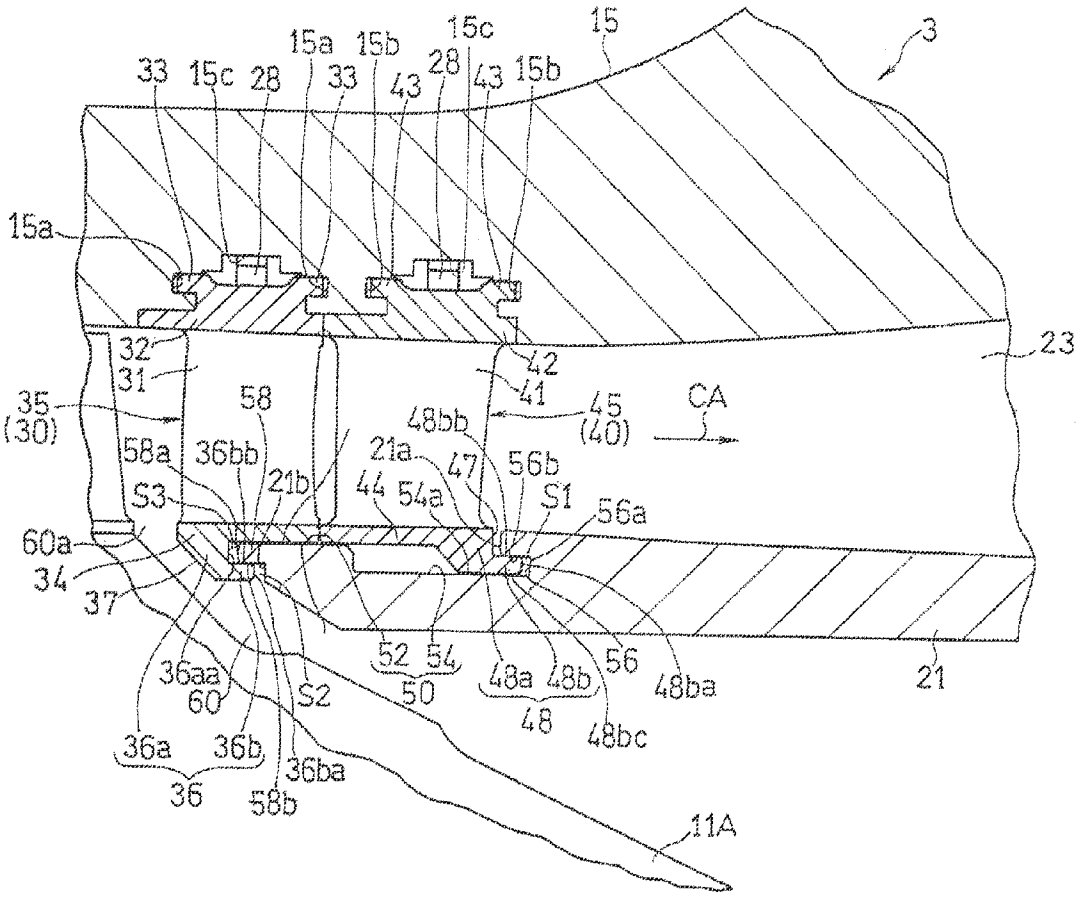
FIG. 4 is an enlarged view of downstream parts of a compressor according to the embodiment.

Next, a support structure of the guide vane piece 45 is drawn in FIG. 4, as reference. In the present embodiment, the outer flange 42 of the guide vane piece 45 is supported on the outer casing 15. The inner flange 44 is supported on the inner diffuser 21. Since the guide vane piece 45 is supported at both sides in this way, the radial displacement of the guide vane piece 45 is restricted. As a result, the vibration of the outlet guide vane 40 is suppressed. Following are descriptions regarding the support structure in the outer casing 15 and the support structure in the inner diffuser 21 in detail.

Initially, the support structure in the outer casing 15 is shown below. As shown in FIG. 4, the outer casing 15 is provided with a pair of front and rear engagement grooves 15*b* which have an annular shape concentric with the center axis C. The engagement parts 43 of the outer flange 42 are inserted into the engagement grooves 15*b*, respectively. The outer casing 15 is divided into two parts in the circumferential direction. The guide vane piece 45 is fitted to the outer casing 15 through the cross-section of the divided parts.

Between each engagement part 43 and the corresponding engagement groove 15*b*, a proper gap (clearance) is provided in both of the axial and the radial directions. This allows the engagement part 43 to be movable in the axial and the radial directions with respect to the engagement groove 15*b*. Note that a leaf spring 28 having a circular-arc shape when viewed from the axial direction is inserted between the outer surface of the outer flange 42 and a mounting groove 15*c* formed on the outer casing 15. The leaf spring 28 presses the outlet guide vane 40 against the engagement groove 15*b* of the outer casing 15. Thus, the outlet guide vane 40 becomes stable.

Next, the support structure in the inner diffuser 21 is described as follows. As shown in FIG. 4, the inner diffuser 21 has a smaller-diameter part 50 which has a smaller outer diameter than other part located upstream of that. The smaller-diameter part 50 has a stepped shape. The smaller-diameter part 50 has a first smaller-diameter part 52 located at an upstream side and a second smaller-diameter part 54, which has a smaller outer diameter than the first smaller-diameter part 52, located downstream of the first smaller-diameter part 52. The inner diffuser 21 has an engagement groove 56 extending to a downstream side from the outer peripheral surface of the second smaller-diameter part 54. An outer surface 56*b* of the engagement groove 56 is a cylindrical surface concentric with the compressor 3, and it can be machined easily.

The outer peripheral surface of the inner flange 44 is located in substantially the same radial position as the outer peripheral surface of the inner diffuser 21, which is adjacent to the smaller-diameter part 50, or located radially outward relatively. As described above, the engagement part 48 is inserted into and engaged in the engagement groove 56. In this way, the second smaller-diameter part 54 and the engagement groove 56 are formed by utilizing available space of an inlet of the inner diffuser 21, which is downstream of the outlet guide vane 40. Because the inner diffuser 21 is divided two parts in the circumferential direction, the guide vane piece 45 can be assembled to the inner diffuser 21 through the cross-section of the divided parts.

Between an axial rear edge (rear end surface) 48*ba* of the engagement part 48*b* of the outlet guide vane 40 and an axially inside surface 56*a* (axially inside surface) of the engagement groove 56 of the inner diffuser 21, a gap S1 is formed. Therefore, axial thermal expansion of the outlet guide vane 40 and axial thermal expansion of the inner diffuser 21 can be absorbed. There is a slight gap between the engagement part 48*b* and the engagement groove 56 during a stopped state. As a result, radial thermal expansion of the outlet guide vane 40 can be permitted.

Moreover, a downstream surface 47 of the inner flange 44 and a recessed rear surface 21*a* of the inner diffuser 21 are close to each other. The outer surface 48*bb* of the engagement part 48*b* of the inner flange 44 and the outer surface 56*b* of the engagement groove 56 of the inner diffuser 21 are also close to each other. The rear edge 48*ba* of the inner flange 44 and the inside surface 56*a* of the inner diffuser 21 are close. The inner surface 48*bc* of the inner flange 44 and the outer peripheral surface (bottom surface) 54*a* of the first smaller-diameter part 52 of the inner diffuser 21 are close to each other. Thus, since a narrow structure is formed as above mentioned, air leakage can be prevented.

<Support Structure of Stator Vane Piece>

A support structure of the stator vane piece 35 is shown in FIG. 4, as reference. Similar to the guide vane piece 45, the stator vane piece 35 is supported at both sides in such a manner that the outer flange 32 is supported on the outer casing 15 and the inner flange 34 is supported on the inner diffuser 21. The radial movement of the stator vane piece 35 is restricted and the vibration of the stator vane 30 is suppressed. The support structure in the outer casing 15 and that in the inner diffuser 21 are described as follows in detail.

At first, here is the support structure in the outer casing 15. The support structure in the outer casing 15 is fundamentally the same as that of the guide vane piece 45. Specifically, the outer casing 15 is provided with a pair of front and rear engagement grooves 15*a*. The engagement parts 33 of the outer flange 32 are inserted into the engagement grooves 15*a*, respectively. A leaf spring 28 is inserted between the outer surface of the outer flange 32 and a mounting groove 15*a* formed on the outer casing 15. Between each engagement part 33 and the corresponding engagement groove 15*a*, a proper gap (clearance) is provided in both of the axial and the radial directions.

Second, the support structure in the inner diffuser 21 is described below. As mentioned above, the inner diffuser 21 has the smaller-diameter part 50. The stator vane piece 35 is on the outer peripheral surface of the smaller-diameter part 50. The foreside of the smaller-diameter part 50 (foreside of the inner diffuser 21) has a protruding part (engaged part) 58 extending forward. The protruding part 58 is between the inner flange 34 and the engagement part 36*b*. The outer peripheral surface of the inner flange 44 of the outlet guide vane 40 and the outer peripheral surface of the inner flange 34 of the stator vane 30 are coplanar with each other.

During the operation of the gas turbine, the engagement part 36*b* is thermally expanded and the outer surface 36*bb* contacts the inner peripheral surface 58*b* of the protruding part 58 of the inner diffuser 21. A front edge surface 58*a* of the protruding part 58 of the inner diffuser 21 is a cylindrical surface concentric with the center axis C of the compressor 3, and therefore the protruding part 58 can be machined easily.

Between the axial rear edge surface (rear edge surface) 36*ba* of the engagement part 36*b* and the front end surface 21*b*, a gap S2 is formed. Between the rear edge surface 58*a* of the protruding part 58 and the rear edge surface 36*aa* of the projecting part 36*a*, a gap S3 is formed. In addition, during the shutdown, a slight gap is formed between the outer surface 36*bb* of the engagement part 36*b* and the inner peripheral surface 58*b* of the protruding part 58. This makes it possible to permit the thermal expansion of the stator vane 30.

The inclined surface 37 which is the foreside surface of the engagement part 36 is inclined radially inward in a rearward direction. The inclined surface 37 and the compressor rotor 11A constitute an inlet 60*a* of an oblique passage 60 extending to the inside of the inner diffuser 21. Air which has gone into inside of the diffuser 21 through the passage 60 can seal lubricating oil fed to the bearing 24B (see FIG. 1) from outside. In other words, the engagement part 36 of the stator vane piece 35 of the present embodiment does not block the passage 60.

Although description has been given of the preferred embodiment of the present invention with reference to the drawings, the present invention can be added, changed or deleted in various ways within a scope of the present invention. For example, to more effectively suppress air leakage between the outlet guide vane 40 and the inner diffuser 21 of FIG. 4, a seal member may be provided between the inner flange 44 and the second smaller-diameter part 54. Consequently, such a structure may be included in the scope of the present invention.

REFERENCE CHARACTERS LIST

3 compressor
15 outer casing
21 inner diffuser
40 outlet guide vane
44 inner flange
48 engagement part
48*a* projecting part
48*b* engagement part
50 smaller-diameter part
56 engagement groove

The invention claimed is:

1. A gas turbine engine comprising:
an outlet guide vane downstream of a compressor;
an outer casing supporting a radially outward part of the outlet guide vane; and
an inner diffuser supporting a radially inward part of the outlet guide vane;
wherein the outlet guide vane includes:
a radially inward inner flange;
a projecting part projecting radially inward from the inner flange; and
an engagement part protruding to one side in an axial direction from a foreside of the projecting part;
wherein the inner diffuser includes a smaller-diameter part having a smaller outer diameter than a part adjacent to the smaller-diameter part;
wherein the inner diffuser is provided with an engagement groove extending to the one side in the axial direction from an outer peripheral surface of the smaller-diameter part or a region in the vicinity of the outer peripheral surface of the smaller-diameter part;
wherein the engagement part is inserted into the engagement groove with a gap between the engagement part and the engagement groove;
wherein a last-stage stator vane of the compressor is upstream of the outlet guide vane;
wherein the outer casing supports a radially outward part of the stator vane;
wherein the inner diffuser supports a radially inward part of the stator vane;
wherein the stator vane includes:
a radially inward stator vane inner flange;
a projecting part projecting radially inward from a foreside of the stator vane inner flange; and a stator vane engagement part protruding to a downstream side from the projecting part;

wherein the inner diffuser includes an engaged part at a foreside of the smaller-diameter part and protruding forward; and wherein the engaged part is between the stator vane engagement part and the stator vane inner flange.

2. The gas turbine engine according to claim 1,

Wherein the gap is formed between an axial rear end surface of the engagement part and an axially inside surface of the engagement groove.

3. The gas turbine engine according to claim 1, wherein a radially outward surface of the engagement part is configured to contact a radially outward surface of the second engagement groove during operation of the gas turbine.

4. The gas turbine engine according to claim 1, wherein the projecting part is at a downstream part of the inner flange, and the engagement part protrudes to a downstream side.

5. The gas turbine engine according to claim 1, wherein a radially inward surface of the engaged part is configured to contact a radially outward surface of the stator vane engagement part, during operation of the gas turbine.

6. The gas turbine engine according to claim 1, wherein an inlet of an oblique introduction passage extending to inside of the inner diffuser is formed between the stator vane engagement part and the compressor.

* * * * *